US006338369B1

(12) United States Patent
Shermer et al.

(10) Patent No.: US 6,338,369 B1
(45) Date of Patent: Jan. 15, 2002

(54) HYDROCARBON VAPOR SENSING

(75) Inventors: William P. Shermer; Edward A. Payne; Seifollah S. Nanaji, all of Greensboro, NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

(21) Appl. No.: 09/651,376

(22) Filed: Aug. 29, 2000

Related U.S. Application Data

(63) Continuation-in-part of application No. 09/188,860, filed on Nov. 9, 1998, now Pat. No. 6,102,085.

(51) Int. Cl.[7] ..... B65B 1/04

(52) U.S. Cl. ..... 141/83; 141/94; 141/59; 73/23.2; 73/31.07

(58) Field of Search ..... 73/23.2, 31.07, 73/23.31, 23.32, 30.03, 30.01; 141/83, 59, 94, 285, 286

(56) References Cited

U.S. PATENT DOCUMENTS

| | | | | | |
|---|---|---|---|---|---|
| 2,703,494 | A | * | 3/1955 | Carney | |
| 3,016,928 | A | | 1/1962 | Brandt | 141/45 |
| 3,073,158 | A | * | 1/1963 | Knauth | |
| 4,147,096 | A | | 4/1979 | Caswell | 98/122 |
| 4,166,485 | A | | 9/1979 | Wokas | 141/52 |
| 4,215,565 | A | | 8/1980 | Zanker | 73/30 |
| 4,566,504 | A | | 1/1986 | Furrow et al. | 141/59 |
| 4,570,686 | A | | 2/1986 | Devine | 141/286 |
| 4,611,729 | A | | 9/1986 | Gerstenmaier et al. | 222/75 |
| 4,653,334 | A | | 3/1987 | Capone | 73/863.81 |
| 4,687,033 | A | | 8/1987 | Furrow et al. | 141/59 |
| 4,749,009 | A | | 6/1988 | Faeth | 141/45 |
| 4,827,987 | A | | 5/1989 | Faeth | 141/59 |
| 4,842,027 | A | | 6/1989 | Faeth | 141/45 |
| 4,871,450 | A | | 10/1989 | Goodrich et al. | 210/151 |
| 4,938,251 | A | | 7/1990 | Furrow et al. | 137/269 |
| 4,967,809 | A | | 11/1990 | Faeth | 141/59 |
| 4,986,445 | A | | 1/1991 | Young et al. | 222/71 |
| 5,013,434 | A | | 5/1991 | Furrow | 210/232 |
| 5,027,499 | A | | 7/1991 | Prohaska | 29/595 |
| 5,040,576 | A | | 8/1991 | Faeth | 141/45 |
| 5,040,577 | A | | 8/1991 | Pope | 141/59 |
| 5,129,433 | A | | 7/1992 | Faeth | 141/45 |
| 5,143,258 | A | | 9/1992 | Mittermaier | 222/73 |
| 5,156,199 | A | | 10/1992 | Hartsell, Jr. et al. | 141/83 |
| 5,195,564 | A | | 3/1993 | Spalding | 141/1 |
| 5,203,384 | A | | 4/1993 | Hansen | 141/59 |
| 5,240,045 | A | | 8/1993 | Faeth | 141/1 |
| 5,267,470 | A | | 12/1993 | Cook | 73/49.7 |
| 5,269,353 | A | | 12/1993 | Nanaji et al. | 141/59 |
| 5,323,817 | A | | 6/1994 | Spalding | 141/1 |
| 5,332,008 | A | | 7/1994 | Todd et al. | 141/5 |
| 5,332,011 | A | | 7/1994 | Spalding | 141/59 |

(List continued on next page.)

FOREIGN PATENT DOCUMENTS

| | | |
|---|---|---|
| GB | 2 316 060 | 2/1998 |

*Primary Examiner*—Steven O. Douglas
(74) *Attorney, Agent, or Firm*—Withrow & Terranova PLLC

(57) ABSTRACT

A fuel dispenser system having a storage tank and a fuel delivery hose extending from the storage tank and terminating at a nozzle. A vapor recovery line extends between the nozzle and the storage tank. The vapor recovery line extends between the nozzle and the storage tank and has a section with a first larger diameter and a second section having a smaller diameter. A vapor pump is operatively connected to the vapor recovery line for moving vapor along said vapor recovery line. A chamber is positioned along the vapor recovery line and includes inlet and outlet ports, and a main sensor chamber. The inlet port connects to the vapor recovery line at a point having the larger diameter. The outlet port connects a point of the smaller diameter. Each of the ports connects to the main sensor chamber where a sensor is positioned for determining the vapor concentration.

24 Claims, 7 Drawing Sheets

U.S. PATENT DOCUMENTS 5,333,654 A 8/1994 Faeth ..... 141/1
5,333,655 A 8/1994 Bergamini et al. ..... 141/59
5,355,915 A 10/1994 Payne ..... 141/83
5,365,985 A 11/1994 Todd et al. ..... 141/392
5,386,812 A 2/1995 Curran et al. ..... 123/520
5,417,256 A 5/1995 Hartsell, Jr. et al. ..... 141/7
5,450,883 A 9/1995 Payne et al. ..... 141/59
5,452,621 A 9/1995 Aylesworth et al. ..... 73/864.81
5,460,054 A 10/1995 Tran ..... 73/863.61
5,464,466 A 11/1995 Nanaji et al. ..... 95/45
5,500,369 A 3/1996 Kiplinger ..... 435/309.1
RE35,238 E 5/1996 Pope ..... 141/59
5,542,458 A 8/1996 Payne et al. ..... 141/7
5,563,341 A 10/1996 Fenner et al. ..... 73/335.11
5,571,310 A 11/1996 Nanaji ..... 96/4
5,592,979 A 1/1997 Payne et al. ..... 141/59
5,625,156 A 4/1997 Serrels et al. ..... 73/863.51
5,626,649 A 5/1997 Nanaji ..... 95/12
5,671,785 A 9/1997 Andersson ..... 141/59
5,720,325 A 2/1998 Grantham ..... 141/59
5,755,854 A 5/1998 Nanaji ..... 95/11
5,780,245 A 7/1998 Maroteaux ..... 435/7.21
5,782,275 A 7/1998 Hartsell, Jr. et al. ..... 141/94
5,803,136 A 9/1998 Hartsell, Jr. ..... 141/7
5,843,212 A 12/1998 Nanaji ..... 96/4
5,857,500 A 1/1999 Payne et al. ..... 141/59
5,860,457 A 1/1999 Andersson ..... 141/59
5,898,108 A 4/1999 Mieczkowski et al. .... 73/118.1
5,911,248 A 6/1999 Keller ..... 141/59
5,913,343 A 6/1999 Andersson ..... 141/59
5,942,980 A 8/1999 Hoben et al. ..... 340/618
5,944,067 A 8/1999 Andersson ..... 141/59
5,956,259 A 9/1999 Hartsell, Jr. et al. .... 364/528.37
5,988,232 A 11/1999 Koch et al. ..... 141/59
5,992,395 A 11/1999 Hartsell, Jr. et al. ..... 123/516
6,026,866 A 2/2000 Nanaji ..... 141/59
6,037,184 A 3/2000 Matilainen et al. ..... 436/177
6,065,507 A 5/2000 Nanaji ..... 141/59
6,070,453 A 6/2000 Myers ..... 73/40.5
6,082,415 A 7/2000 Rowland et al. ..... 141/59
6,102,085 A 8/2000 Nanaji ..... 141/83
6,103,532 A 8/2000 Koch et al. ..... 436/55
6,123,118 A 9/2000 Nanaji ..... 141/4

* cited by examiner

HYDROCARBON VAPOR SENSING

This application is a Continuation-in-Part of prior application Ser. No. 09/188,860 filed Nov. 9, 1998, now U.S. Pat. No. 6,102,085.

FIELD OF THE INVENTION

The present invention relates generally to sampling vapor streams for concentrations of hydrocarbons contained therein. The invention is particularly suited for detecting hydrocarbon levels in fuel dispenser vapor return passages and the protection of hydrocarbon sensors from contamination by liquid hydrocarbon.

BACKGROUND OF THE INVENTION

For the past several years, the Environmental Protection Agency has had regulations to limit the amount of fuel vapor released into the atmosphere during the refueling of a motor vehicle. During a conventional or standard fueling operation, incoming fuel displaces fuel vapor from the head space of a fuel tank and out through the filler pipe into the atmosphere if not contained and recovered. The air pollution resulting from this situation is undesirable. Currently, many fuel dispensing pumps at service stations are equipped with vapor recovery systems that collect fuel vapor vented from the fuel tank filler pipe during the fueling operation and transfer the vapor to a fuel storage tank.

Recently, onboard, or vehicle carried, fuel vapor recovery and storage systems (commonly referred to as onboard recovery vapor recovery or ORVR) have been developed in which the head space in the vehicle fuel tank is vented through an activated charcoal-filled canister so that the vapor is adsorbed by the activated charcoal. Subsequently, the fuel vapor is withdrawn from the canister into the engine intake manifold for mixture and combustion with the normal fuel and air mixture. The fuel tank head space must be vented to enable fuel to be withdrawn from the tank during vehicle operation.

In typical ORVR systems, a canister outlet is connected to the intake manifold of the vehicle engine through a normally closed purge valve. The canister is intermittently subjected to the intake manifold vacuum with the opening and closing of the purge valve between the canister and intake manifold. A computer which monitors various vehicle operating conditions controls the opening and closing of the purge valve to assure that the fuel mixture established by the fuel injection system is not overly enriched by the addition of fuel vapor from the canister to the mixture.

Fuel dispensing systems having vacuum assisted vapor recovery capability which are unable to detect ORVR systems will continue to operate even though there is no need to do so. This can waste energy, increase wear and tear, ingest excessive air into the underground storage tank and cause excessive pressure buildup in the underground storage tank due to the expanded volume of hydrocarbon saturated air. Recognizing an ORVR system and adjusting the fuel dispenser's vapor recovery system accordingly eliminates the redundancy associated with operating two vapor recovery systems for one fueling operation. The problem of incompatibility of assisted vapor recovery and ORVR was discussed in "Estimated Hydrocarbon Emissions of Phase II and Onboard Vapor Recovery Systems" dated Apr. 12, 1994, amended May 24, 1994, by the California Air Resources Board. That paper suggests the use of a "smart" interface on a nozzle to detect an ORVR vehicle and close one vapor intake valve on the nozzle when an ORVR vehicle is being filled.

Adjusting the fuel dispenser's vapor recovery system will mitigate fugitive emissions by reducing underground tank pressure. Reducing underground tank pressure minimizes the "breathing" associated with pressure differentials between the underground tank and ambient pressure levels. If the vacuum created by the fuel dispenser's vapor recovery system is not reduced or shut off, the underground tank pressure will increase to the extent that hydrocarbons are released through a pressure vacuum valve or breathing cap associated with the underground tank. In certain applications, reducing the vacuum created by the fuel dispenser's vapor recovery system when an ORVR system is detected permits the ingestion of a volume of air into the underground tank. When saturated with hydrocarbons, the volume of air expands to a volume approximately equal to the volume of fuel dispensed. Adjusting the fuel dispenser's vapor recovery system in this manner minimizes breathing losses associated with the underground tank.

A system and method for doing so is disclosed in commonly assigned U.S. Pat. No. 5,782,275 the disclosure of which is incorporated herein by reference. If the apparatus of the '275 patent detects an onboard system, it could either shut off the vapor pump completely, or control the pump to supply the amount of air to the storage tank needed to replenish the volume of liquid taken from the underground tank and thus eliminate breathing losses. The apparatus of the '275 patent includes a hydrocarbon sensor mounted in the vapor return passage of the hose used to fuel the vehicle. Further developmental work on the concept of hydrocarbon vapor sensing has revealed that the optimal point for monitoring the hydrocarbon concentration of vapors returning to the underground fuel tank may be within the dispenser.

There are potential difficulties associated with mounting a hydrocarbon sensor in the vapor return path of coaxial fuel delivery hose. These difficulties include addressing fire safety code requirements for an intrinsically safe device and routing sensor wiring through the hose. Moreover, dispenser hoses are equipped with "break away" fittings designed to cope with consumers who drive away from dispensers with a nozzle still in the vehicle fill pipe. Any type of wiring within the hose would have to be designed to be severable without generating a spark that could cause fire. Solving these technical problems could be expensive; accordingly, it would be advantageous to use a less expensive option.

The present invention addresses these and other problems as discussed in detail below. It should be recognized that the present invention provides numerous advantages some of which may not be detailed herein but which will be readily apparent to one of ordinary skill.

SUMMARY OF THE INVENTION

The present invention provides several advantages for systems requiring the determination of vapor concentration in a vapor recovery dispenser vapor return passage. The present invention includes a vapor sensor chamber positioned along the vapor recovery line. The vapor sensor chamber includes inlet and outlet ports, and a main sensor chamber. The outlet port connects to the vapor recovery line where a pressure drop occurs thereby causing vapor to be drawn into the inlet port, through the main sensor chamber, and out the outlet port back to the vapor recovery line.

In one embodiment, the invention includes the vapor return line, and the vapor sensor chamber. The outlet port connects to the vapor recovery line at a point having a smaller diameter than where the inlet port connects. This results in a pressure drop that pulls the vapor through the chamber. A sensor is positioned within the main sensor chamber for sensing the vapor.

The main sensor chamber may be designed such that the outlet port connects to at a low point to capture condensation that has accumulated within the chamber and direct it towards the vapor recovery line. The chamber may be positioned above the vapor recovery line such that vapor condensation within the chamber moves towards the vapor recovery line.

A variety of sensors may be used for determining the vapor. In one embodiment, an infrared vapor sensor is positioned within the main sensor chamber. Additionally, the sensor may detect either an oxygen concentration within the vapor, or a hydrocarbon concentration.

In another embodiment, the sensor chamber is used within a fuel dispenser environment. Fuel is delivered to a user from a storage tank, through a fuel delivery hose that extends from the storage tank and terminates at a nozzle where fuel is delivered to the user. A vapor recovery line extends between the nozzle and storage tank which includes the sensor chamber and sensor. A vapor pump is operatively connected to the vapor recovery line for moving the vapor along the line.

The present invention may also be a method of determining the vapor concentration within a vapor recovery system. The method includes drawing vapor through a vapor recovery line and causing a pressure drop at a point along the vapor recovery line which drawing vapor into the sensor chamber. A sensor within the chamber determines the concentration, before the vapor is returned to the vapor recovery line.

BRIEF DESCRIPTION OF THE DRAWINGS

The above and other objects, features, and advantages of the present invention will be more clearly understood from the following detailed description taken in conjunction with the accompanying drawings, in which.

DESCRIPTION OF THE INVENTION

Figure 1:
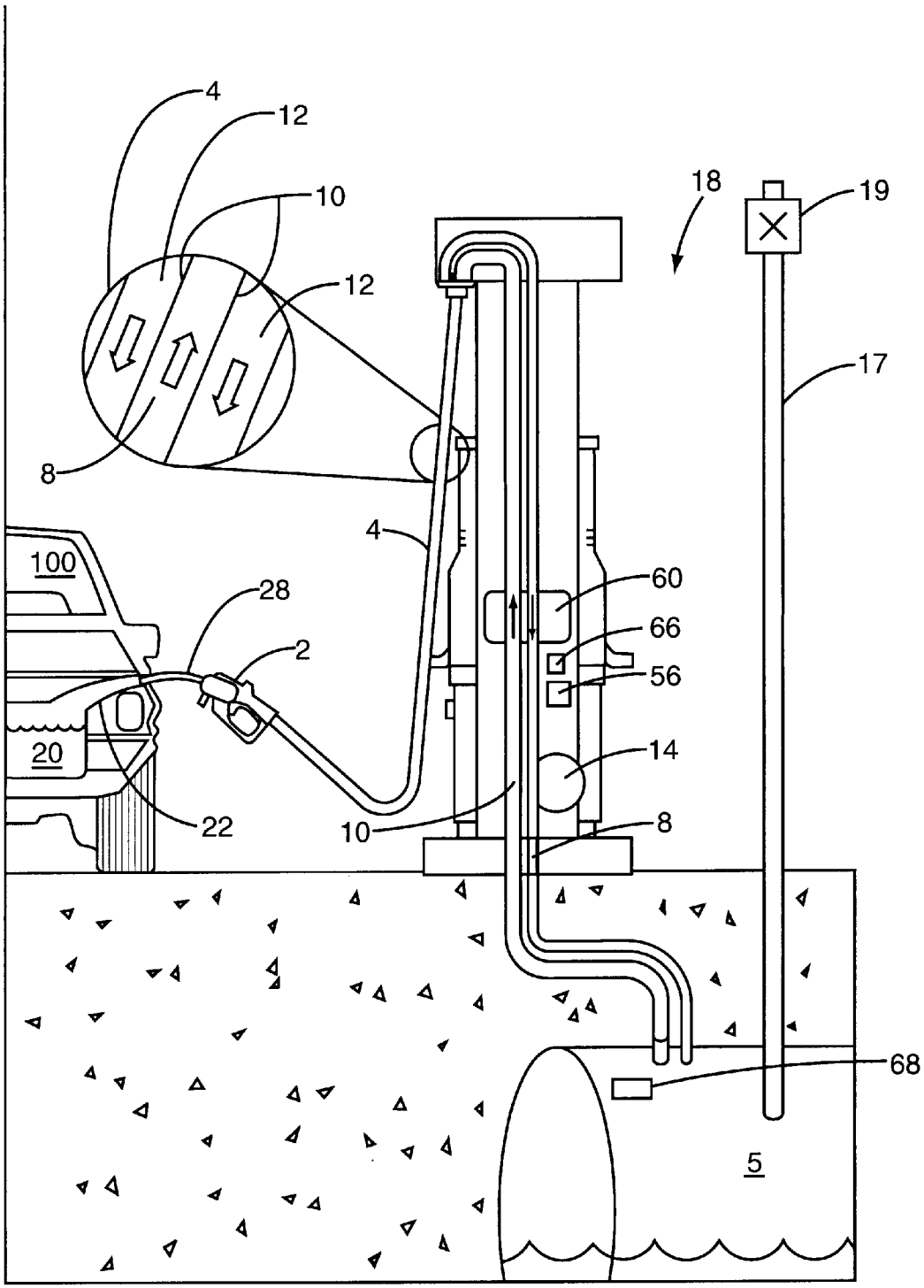
FIG. 1 is an elevational and partial sectional view of a typical gasoline dispenser installation having a vapor recovery system.

Referring now to the drawings in general and FIG. 1 in particular, it will be understood that the illustrations are for the purpose of describing a preferred embodiment of the invention and are not intended to limit the invention thereto. As best seen in FIG. 1, in a typical service station, an automobile 100 is shown being fueled from a gasoline dispenser or pump 18. A spout 28 of nozzle 2 is shown inserted into a filler pipe 22 of a fuel tank 20 during the refueling of the automobile 100.

A fuel delivery hose 4 having vapor recovery capability is connected at one end to the nozzle 2, and at its other end to the fuel dispenser 18. As shown by the cutaway view of the interior of the fuel delivery hose 4, an annular fuel delivery passage 12 is formed within the fuel delivery hose 4 for distributing liquid gasoline pumped from an underground storage tank 5 to the nozzle 2. Also within the fuel delivery hose 4 is a tubular vapor recovery passage 8 that normally transfers fuel vapors expelled from the vehicle's fuel tank 20 to the underground storage tank 5. The fuel delivery hose 4 is depicted as having an internal vapor recovery hose 10 for creating the vapor recovery passage 8. The fuel delivery passage 12 is formed between the hose 10 and hose 4. The terms vapor recovery passage and vapor return passage as used herein are defined to mean the entire flow path along which vapors recovered from a vehicle travel as they are returned to a storage point. One such storage point is an underground tank, however, other types of storage points to include intermediate vapor collection devices may also be used. Thus, any device installed in a vapor return passage may be installed at any along the path described above.

A vapor recovery pump 14 provides a vacuum in the vapor recovery passage 8 for removing fuel vapor during a refueling operation. The vapor recovery pump 14 may be placed anywhere along the vapor recovery passage 8 between the nozzle 2 and the underground fuel storage tank. The vapor recovery system using the pump 14 may be any suitable system such as those shown in U.S. Reissue Pat. No. 35,238 to Pope; U.S. Pat. No. 5,195,564 to Spalding; U.S. Pat. No. 5,333,655 to Bergamini et al.; or U.S. Pat. No. 3,016,928 to Brandt. Various ones of these systems are now in commercial use, recovering vapor during refueling of conventional, non-ORVR vehicles.

As shown in FIG. 1, the underground tank 5 includes a vent 17 and a pressure-vacuum vent valve 19 for venting the underground tank 5 to atmosphere. The vent 17 and vent valve 19 allow the underground tank 5 to breathe in order to substantially equalize the ambient and tank pressures. In typical applications, maintaining tank pressure between the limits of pressure and vacuum is sufficient. Typical ranges of pressure and vacuum will range between +3 inches of water to −8 inches of water.

Figure 2:
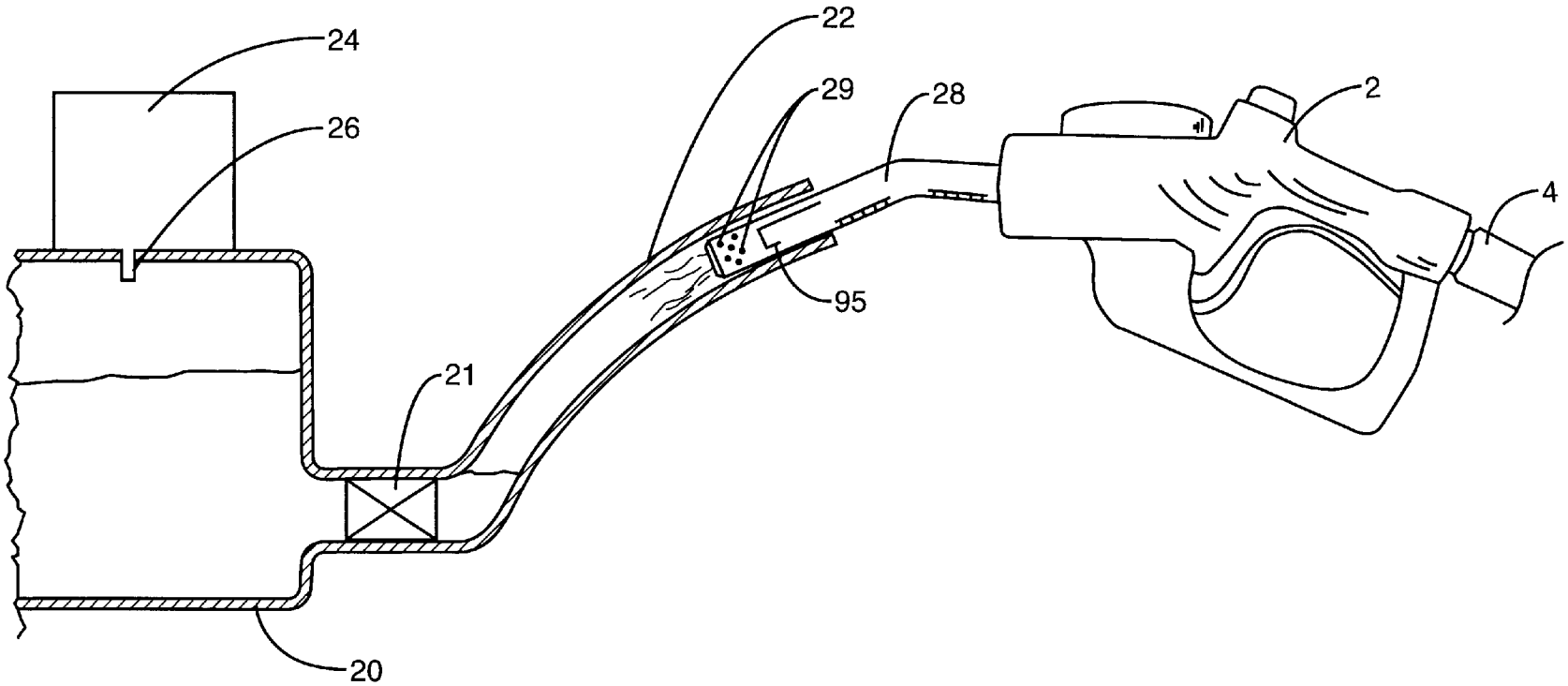
FIG. 2 depicts a typical vacuum assist vapor recovery nozzle and the cross section of a fuel tank of a vehicle equipped with onboard recovery vapor recovery.

Turning now to FIG. 2, there is illustrated a schematic representation of a vehicle fuel tank 20 of an ORVR vehicle having an associated onboard vapor recovery system 24. These onboard vapor recovery systems 24 typically have a vapor recovery inlet 26 extending into the tank 20 (as shown) or the filler pipe 22 and communicating with the vapor recovery system 24. In the ORVR system of FIG. 2, incoming fuel provides a temporary seal in fill neck 22 to prevent vapors from within the tank 20 to escape. This sealing action is often referred to as a liquid seal. As the tank fills, pressure within tank 20 increases and forces vapors into the vapor recovery system 24 through the vapor recovery inlet 26. Other ORVR systems may use a check valve 21 along the fill neck 22 to prevent further loss of vapors. The check valve 21 is normally closed and opens when a set amount of gasoline accumulates over the check valve within the fill neck 22.

The spout 28 of the nozzle 2 has numerous apertures 29. The apertures 29 provide an inlet for fuel vapors to enter the vapor recovery path 8 of fuel dispenser 18 from the vehicle's filler pipe 22. As liquid fuel rushes into the fuel tank 20 during a fueling of a vehicle not equipped with an ORVR system, fuel vapors are forced out of the fuel tank 20 through the fill pipe 22. The fuel dispenser's vapor recovery system pulls fuel vapor through the vapor recovery apertures 29, along the vapor recovery path 8 and ultimately into the underground tank 5 (as shown in FIG. 1).

As discussed above, an apparatus for determining the presence of a vehicle having a vapor recovery system is disclosed in U.S. Pat. No. 5,782,275, the contents of which are incorporated herein by reference. This system includes a sensor for determining the hydrocarbon concentration in the vapor recovery passage 8. It would be desirable to mount the hydrocarbon sensor in a location that is protected from weather and that does not present the engineering challenge of mounting a sensor within a hose. The side column of a typical high-hose gasoline dispenser, such as the Gilbarco MPD® series of dispensers, has been found to meet these requirements. Other dispensers typically will have comparable suitable locations. The side columns typically include a vertical length of vapor return piping that forms part of the vapor recovery passage 8 shown in FIG. 1. During fuel dispensing, slugs of liquid gasoline pass through this portion of the vapor recovery passage 8 with some frequency. It is believed that one cause of the presence of this liquid is the "topping off" of a vehicle fuel tank 20. The topping off causes fuel to splash back into the fill pipe 22 to the extent that it floods the apertures 29 in nozzle spout 28. The vacuum generated by vapor recovery pump 14 can be strong enough to pull this liquid from the nozzle through the vapor return piping in the dispenser. Thus any hydrocarbon sensor installation in the dispenser vapor return piping directly in the vapor return path will be flooded with liquid hydrocarbon. It will be readily appreciated that this flooding may render the sensor inoperative, or at least, inaccurate.

The present invention addresses this problem by providing a sensor installation that provides vapor and fluid communication between the hydrocarbon sensor and the vapor passing through the vapor passage 8 without exposing the sensor to damaging liquid hydrocarbon contact. In its broadest sense the present invention provides a sensing chamber adjacent the vapor return passage. The sensing chamber is oriented such that it admits vapors while resisting the entry of substantially all liquid that may be present in the vapor passage 8.

Figure 3:
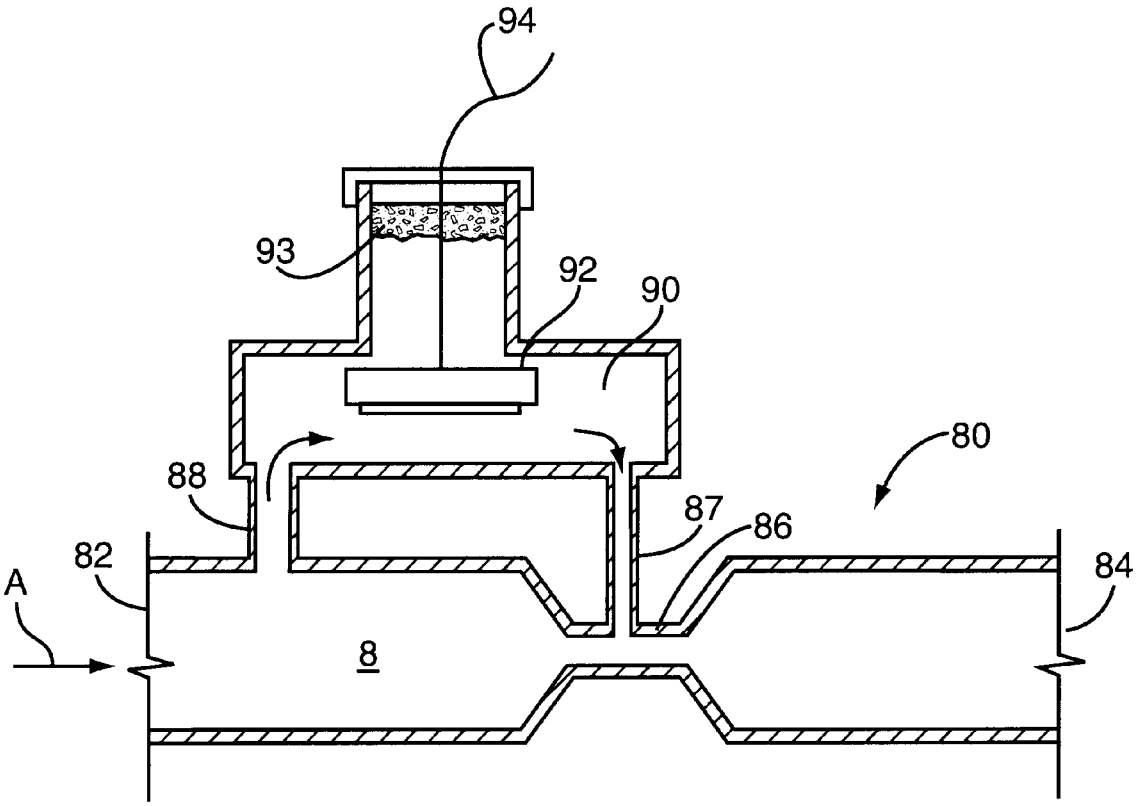
FIG. 3 is a schematic representation of a fueling dispenser vapor return line showing the installation of a hydrocarbon vapor sensor that uses a venturi device to admit a portion of a return vapor flow into contact with a hydrocarbon sensor.

FIG. 3 illustrates a venturi embodiment 80 of the present invention. Vapors enter the sensor apparatus at 82 and exit at 84. The direction of vapor travel through the apparatus is indicated by arrows A. Positioned between inlet 82 and outlet 84 is venturi 86. The pressure differential created as a vapor travels through the constricted passage of venturi 86 creates a suction in suction line 87. Sensor housing 90 defines a sensor chamber 91 and is positioned adjacent and, in this embodiment, substantially parallel to vapor passage 8. The chamber 91 is in fluid communication with vapor passage 8 via suction line 87 and vapor inlet 88. The low pressure suction created by venturi 86 draws vapors through vapor inlet 88 into sensor chamber 91 in contact with hydrocarbon sensor 92. The vapor is then returned to vapor passage 8 via suction line 87. Hydrocarbon sensor 92 communicates with the dispenser vapor recovery control system via electrical lead 94. Safety code requirements dictate that an intrinsically safe vapor seal 93 be provided to seal electrical lead 94 and to prevent the escape of vapors into the dispenser housing. In one embodiment, sensor chamber 91 is of a cylindrical shape although other shapes may be used. Sensor chamber 91 may be tilted out of parallel with vapor passage 8 in some installations to promote drainage of any condensation that may collect inside sensor chamber 91.

Figure 4:
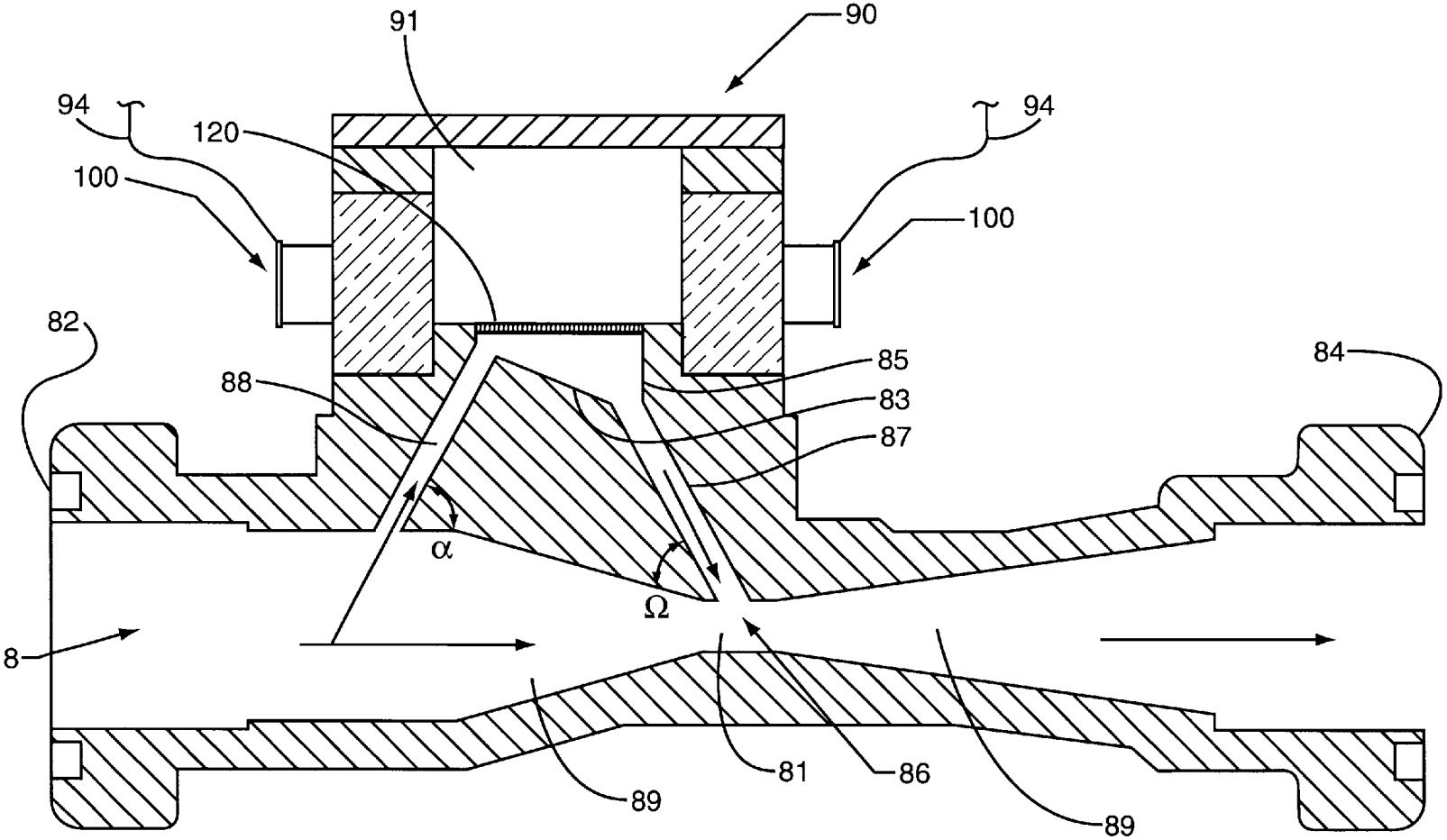
FIG. 4 is a side view illustrating another embodiment of a vapor pressure constrictor positioned within the vapor passage.

This embodiment provides for a controlled sampling of the vapor stream in vapor return passage 8 while minimizing any exposure of sensor 92 to direct contact with liquid hydrocarbon. Use of the venturi 86 takes advantage of the energy in the vapor stream to provide the motive power for drawing a continuous sample of the vapor into contact with sensor and returning the continuous sample vapor return passage 8. FIG. 4 discloses another embodiment of a flow constrictor within the vapor passage 8. The vapor passage 8 has a varying diameter in proximity to the sensor housing 90. The diameter is larger where the vapor inlet 88 connects to the vapor passage 8 than where the suction line 87 connects. This varying diameter causes a pressure drop to pull vapor from the vapor passage 8, into the vapor inlet 88, through the sensor chamber 91, and out the suction line 87. In one embodiment, a venturi 86 is placed along the vapor recovery line 8 that includes a constricted throat 81 between upstream and downstream tapered sections 89. A pressure drop results as the vapor is forced through the constricted throat 81. In one embodiment, suction line 87 intersects the vapor passage 8 at the throat 81 as illustrated in FIGS. 3 and 4. However, the suction line 87 may also intersect upstream or downstream of the throat 81 provided there is an adequate pressure drop between the vapor inlet 88 to pull the vapor through the sensor chamber 91. In one embodiment, a pressure drop of about 0.25 inches WC is adequate to generate vapor flow through the sensor chamber 91. In another embodiment, a larger pressure drop, such as about 0.50 inches WC was determined to cause a quicker response time for determining the vapor concentration. Alternatively, another type of constrictor such as a laminar flow element, orifice plate, or aperture controlled orifice may be positioned within the vapor passage 8 to create a pressure drop. Each of these elements works in a similar fashion as the venturi 86 to constrict the diameter of the vapor passage 8 causing a pressure drop.

As illustrated in FIG. 4, the vapor inlet 88 and suction line 87 are positioned at angles $\alpha$ and $\Omega$ relative to the vapor passage 8. This positioning causes vapor to more easily enter and exit the sensor chamber 91. The angles $\alpha$ and $\Omega$ of the inlet and outlet ports 88, 87 may differ from each other, and be within a variety of ranges.

In one embodiment, the vapor inlet 88 enters the sensor chamber 91 at a point closer to the sensor 100 or 92 then the suction line 87. This positioning assists in the vapor passing through the sensor 92, 100 prior to being drawn from the sensor chamber 91 into the suction line 87. The positioning of the vapor inlet 88 may varying, provided the vapor passes through the sensor 92, 100 prior to being dispelled through the suction line 87.

The sensor chamber 91 preferably includes outer walls 83, 85 which are angled towards the suction line 87. The vapor carried within the vapor passage 8 typically has a vapor ratio high enough to generate condensation. The condensation collects and is directed out the sensor chamber 91 and into the suction line 87. Likewise, liquid may enter the sensor chamber 91 from condensation formed within the vapor passage 8, or swallowed during a over-aggressive "topping-off" during the fueling process. The design of the sensor chamber 88 with outer walls 83, 85 leading into the suction line 87 prevents liquid from becoming trapped inside which may affect the sensor readings. The design of the chamber 91 may vary depending upon the type of sensor, and the parameters of the vapor recovery system.

A baffle 120 may extend across the sensor chamber 91 to prevent liquid from contacting the sensor 100 as illustrated in FIG. 4. Baffle 120 stops liquid from passing into the upper reaches of the chamber 91, yet allows for vapor to pass. Baffle 120 may be constructed from a variety of materials including a hydrophobic material, coalescing mesh, and a hydrocarbonphobic material. Baffle 120 may also be a solid member having protrusions or legs on the periphery that allow vapor to circulate throughout the sensing chamber 91.

Figure 5:
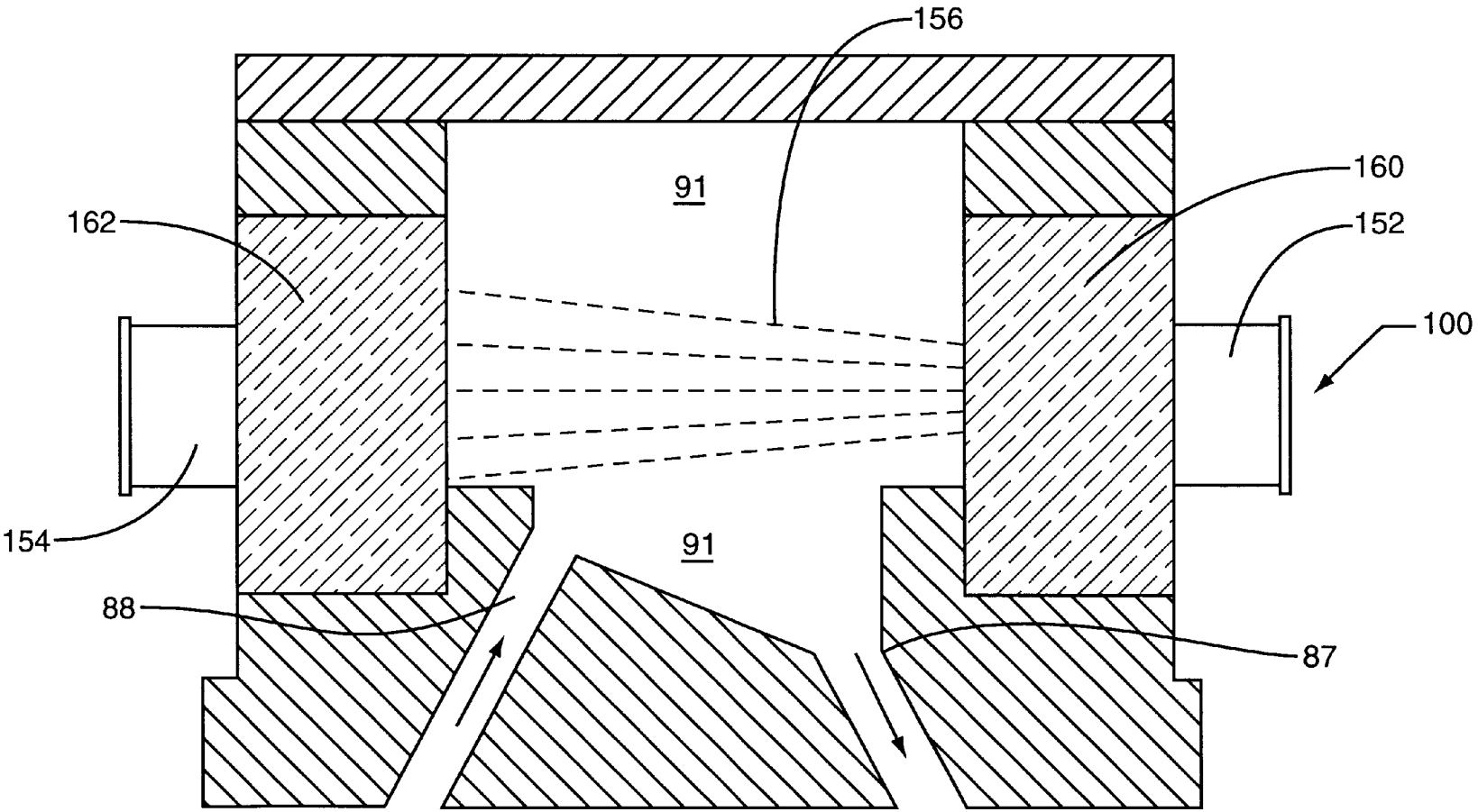
FIG. 5 is a side view illustrating one embodiment of an infrared sensor positioned within the sensor chamber.

FIG. 5 illustrates one embodiment of a sensor 100 as being an infrared sensor positioned within the sensor chamber 91. Sensor includes an infrared emitter 152 and an infrared detector 154 like that described in "Infrared Light Sources" dated February 2000 and manufactured by Ion Optics, Inc. that is herein incorporated by reference. Preferably, the infrared emitter 152 is either a solid state or a black body radiator with an appropriate filter, if required. The infrared emitter 152 irradiates to the infrared detector 154 through a cross-section of sampled vapor within the sensor chamber 91. The infrared detector 154 is either solid state or pyro-electric infrared (PIR). The attenuation in the infrared spectrum 156 caused by the absorption of infrared by hydrocarbons is detected by the detector 154.

The infrared emitter 152 contains a window 160 through which the infrared spectrum 156 emitted by the infrared emitter 152 passes. The primary purpose of the window 160 is to provide a barrier to prevent the infrared emitter 152 from being contaminated by the vapor. In order for the infrared spectrum 156 to pass through for detection by the infrared detector 154, the window 160 allows light of the infrared spectrum 156 to pass through. The wavelength of the infrared spectrum 156 wavelengths is approximately 4 micro meters and the hydrocarbon vapor is sensed at approximately 3.3 to 3.4 micro meters. The preferred embodiment uses a window 160 constructed out of sapphire because it does not attenuate the infrared spectrum 156 materially at this wavelength. However, windows 160 made out of germanium, calcium flouride or silicon may be better for infrared spectrums 156 with longer wavelengths. Similarly, the infrared detector 154 also has a window 162 to allow the infrared spectrum 156 to pass through for the same reasons as discussed above.

Figure 6:
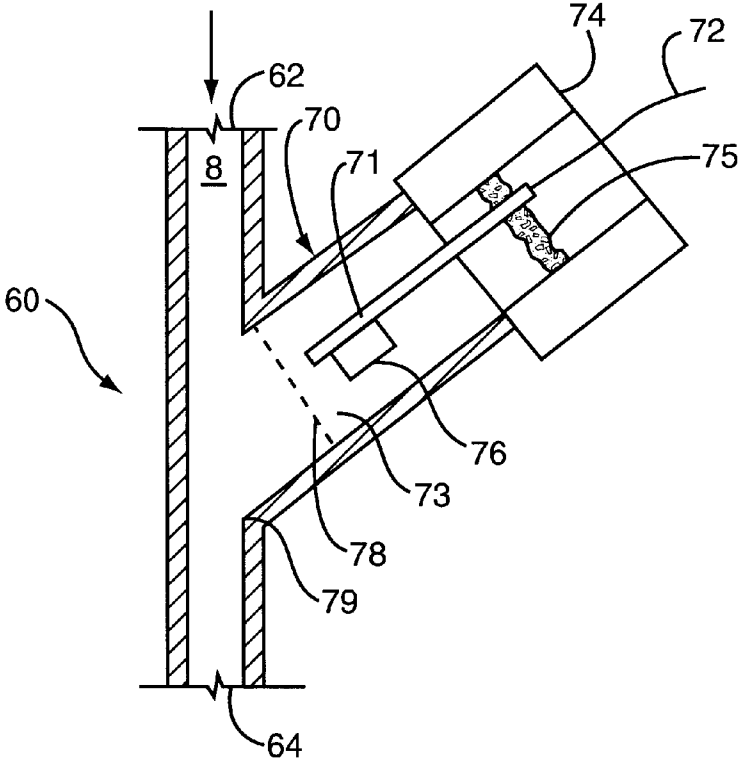
FIG. 6 is a schematic representation of a fueling dispenser vapor return line showing the installation of a hydrocarbon vapor sensor in a sensing housing so as to provide fluid communication with a return vapor flow.

Another embodiment is depicted in FIG. 6. Hydrocarbon vapors being returned to underground tank 5 pass through vapor inlet 62 and exit at vapor outlet 64. An angled hydrocarbon sensing housing 70 is mounted in fluid communication with vapor return passage 8. The sensing housing 70 is angled with respect to vapor return passage 8. Sensor chamber 73 is located within this angled housing 70 and is open for fluid communication with vapor return passage 8. Hydrocarbon sensor 76 is mounted on printed circuit board 71 and the combination is mounted within sensor chamber 73. A cap 74 that includes an intrinsically safe seal 75 is provided atop housing 70 to meet safety regulations. The hydrocarbon sensor 76 communicates with the dispenser vapor recovery system via electrical lead 72.

The positioning of hydrocarbon sensor 76 out of the path of the vapor return passage 8 shields the sensor 76 from substantially all the exposure to any liquid hydrocarbon. It will be readily appreciated that any liquid passing through the vapor return passage 8 is unlikely to make the severe turn required to enter the sensing chamber 73 and travel all the way to sensor 76. Nevertheless, vapors easily can fill sensing chamber 73. Experience with this configuration has indicated that sensing chamber 73 does not act as a "dead space" and that the vapor concentration in sensing chamber 73 accurately reflects that of the vapor return passage 8. That is, as the hydrocarbon vapor concentration rises and falls in vapor return passage 8, it also rises and falls in sensing chamber 73.

Despite the advantages of this design, very large slugs of hydrocarbon liquid can occasionally contaminate hydrocarbon sensor 76. In particular, an eddy effect created at the lower edge 79 of the vapor inlet can cause liquid to travel up the lower wall of sensing chamber 73. It is believed that this situation may be addressed by the inclusion of a filter 78 in sensing chamber 73. The function of this filter is to block or, alternatively, breakup any liquid entering sensing chamber 73. Desirably, the filter 78 is comprised of a hydrophobic material that resists the passage of liquid but permits vapor passage therethrough. These types of materials are well known to one of ordinary skill. Even more desirably, the filter is constructed of a hydrocarbonphobic material which is a material that has a particular ability to repel liquid hydrocarbon. Alternatively, the filter may be constructed of a coalescing mesh to perform the same function. The mesh would break the liquid up into small droplets and thus minimize any contamination effect on filter 76. The mesh filter would require periodic change outs as it is believed that the mesh will become covered with a varnish or gummy deposits left by the hydrocarbon vapor in similar fashion to the deposits that build up in the intake systems of an automobile engine.

Figure 7:
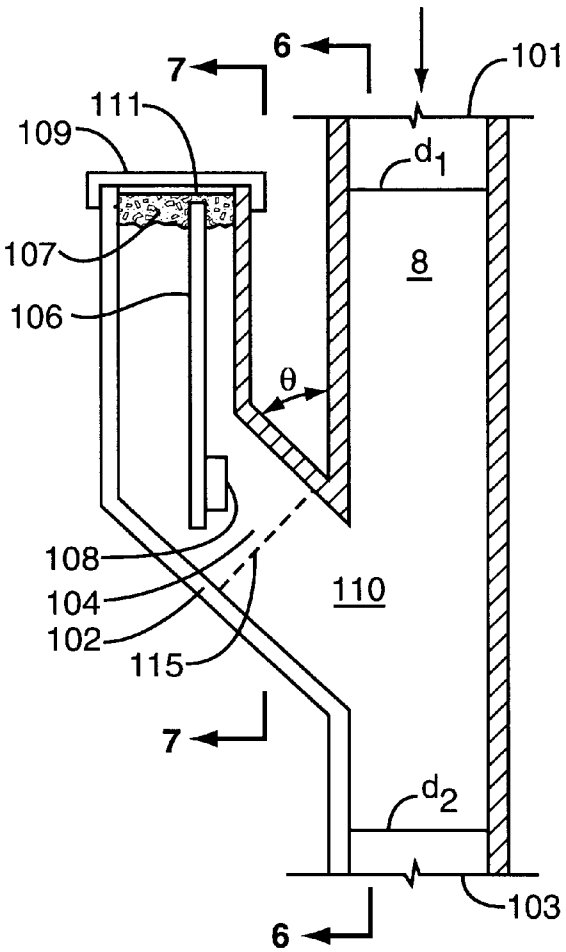
FIG. 7 is a schematic representation of an embodiment of the angled sensing housing of the present invention.
Figure 9:
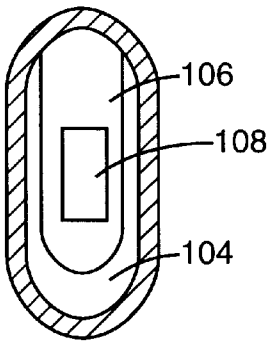
FIG. 9 is a cross sectional view taken along 7—7 in FIG. 7 to illustrate the positioning of the hydrocarbon sensor in the sensing chamber.
Figure 8:
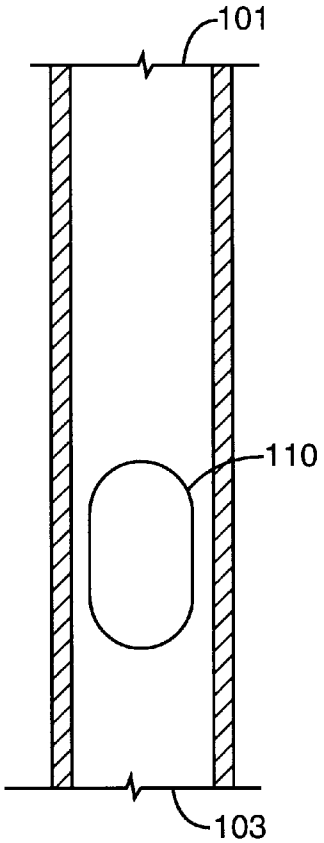
FIG. 8 is a cross sectional view taken along 6—6 in FIG. 7.

Turning now to FIGS. 7–9, there is illustrated one embodiment of the present invention. This embodiment includes a sensing housing 102 which is in fluid communication with the return vapor flow in the vapor return passage 8. The housing 102 is provided with a seal 107 and cap 109. The sensor communicates with a dispenser vapor recovery system or other system via electrical lead 111.

This embodiment addresses sensor contamination by liquid hydrocarbon. Hydrocarbon vapors enter at vapor inlet 101 and exit via vapor outlet 103. Sensing housing 102 is angled with respect to the direction of vapor return passage 8. A housing angle θ is defined between sensing housing 102 and the vapor return passage 8. The housing angle refers to the angle between the sensing housing and the direction of vapor flow through the vapor return passage 8. The direction of vapor flow typically is a straight line defined between vapor inlet 101 and vapor outlet 103. Desirably the housing 102 is installed in a straight line section of the vapor return passage 8. Hydrocarbon sensor 108 is mounted on printed circuit board 106 and is positioned within sensing chamber 104. As was discussed above, a filter 115 may be provided in sensing chamber 104 if desired.

It has been found that liquid entry into sensing chamber 104 may be minimized through the selection of angle θ and the shape of vapor inlet 110. It will be appreciated that when the angle θ between the sensing housing and the vapor return passage 8 is 90°, the sensing housing 102 forms a T shape in relation to the vapor return passage 8. As that angle decreases towards 0, the sensing chamber 104 becomes more parallel to the direct of flow through vapor return passage 8. Moreover, the sensing chamber increasingly turns away from the vapor return passage 8 and associated vapor flow as the housing angle decreases. The housing angle should be selected to provide fluid communication between the sensing chamber 104 and the sensor 108. Desirably, it has been found that an optimal angle for providing proper fluid communication with the vapor return passage and discouraging fluid entry into the sensing chamber 104 is between about 45° and about 60°. This angle provides the best performance for admitting vapor while at the same time having a tendency to resist the entry of any liquid into sensing chamber 104. Other angles less than 45° also have this capability, but may tend to create an undesirable dead space in sensing chamber 104. As the housing angle increases from about 60° the tendency for liquid entry into sensing chamber 104 tend to increase. It should be understood than angles far above the range specified above may not provide the desired resistance to liquid entry into the sensing chamber 104.

Any difficulties with a housing angle of about 60° or greater may be addressed by varying the diameter of vapor return passage on either side of the sensing housing 102. The diameter of the vapor return passage 8 upstream of sensing housing 102 is shown as $d_1$ in FIG. 7. The diameter downstream of vapor sensing housing 102 is shown as $d_2$. Desirably, $d_2$ is configured to be substantially larger than $d_1$ so as to create a vapor "sink."then the liquid eddying problem is minimized. In a preferred embodiment the $d_2/d_1$ ratio is between about 1.25 and about 1.5.

Another factor affecting liquid entry is the shape of vapor inlet 110. In this preferred embodiment vapor inlet 110 and sensing chamber 104 have a substantially oval or, equivalently, a substantially elliptical shape. This shape is best illustrated in FIG. 8, which is a sectional view taken along 6—6 of FIG. 7. It is believed that the vapor inlet 110 should be provided with rounded corners or should exclude angled corners as experience has shown that the angled corners tend to accentuate the eddy effect described above. Other shapes may be used as well to include a circular vapor inlet opening. A substantially square vapor inlet 110 could be used so long as the right angle corners are rounded off with a radius sufficiently large to avoid liquid entry into the sensing chamber 104.

FIG. 9 is a cross sectional view taken along 7—7 in FIG. 7, and illustrates an enlarged view of the hydrocarbon sensor 108 positioned in the sensing chamber 104. Desirably, the lower edge of printer circuit board 106 is rounded to match the contour of the sensing chamber 104. Although the printed circuit board is shown positioned above the bottom of the sensing chamber 104, it may be lowered so that the lower edge of the printed circuit board 106 rests on the lower edge of the sensing chamber 104.

Figure 7A:
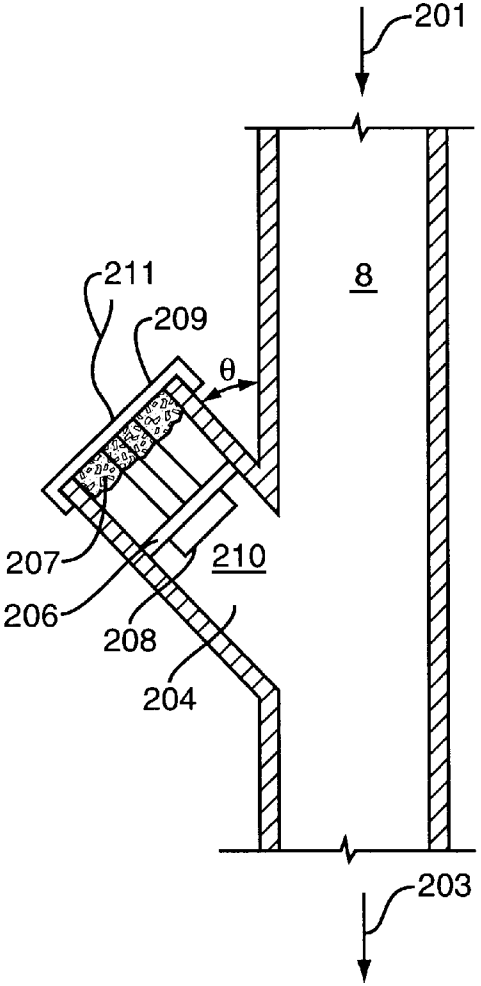
FIG. 7A is a schematic representation of another embodiment of the angled sensing housing of the present invention.

An alternative sensor placement in the sensing housing is illustrated in FIG. 7A. This embodiment includes a sensing housing 202 that is angled to the flow of vapor through vapor passage 208. The path taken by hydrocarbon vapors is indicated by arrows 201, 203. The sensing housing 202 includes vapor inlet 210 and sensor chamber 204. Sensor 208 is mounted on printed circuit board 206 which is in communication with other vapor recovery system components via electrical lead 211. A cap 209 and intrinsically safe seal 207 are provided to prevent the escape of hydrocarbon vapors from the sensing housing 202. This embodiment may further include a hydrophobic filter (not shown) as needed. The angle θ between sensor housing 202 and the direction of vapor flow through vapor return passage 208 will be the same as that described hereinabove.

Additional features may be added to the present invention to address condensation that may collect in sensing chamber 104 and on hydrocarbon sensor 108 during daily heating and cooling cycles experienced by dispenser 18. This condensation problem may be particularly troublesome in locations that experience large temperature swings between day and night. It is desirable to provide some means for heating the sensing chamber and/or the hydrocarbon sensor 108 and its printed circuit board 106 to deal with this condensation problem. One approach is to provide well known resistive heaters in printed circuit board 108. The heaters could be cycled on and off as needed by an electronic controller depending on the temperature sensed inside sensing chamber 104. This approach requires additional electronic components and efforts to meet safety code requirements for electrical installations in hazardous environments.

Another approach would be to provide a warming blanket around sensing housing 102. The operation of the warming blanket could be initiated in several ways. First, its operation could be controlled by a timer to cycle on and off at set times during the day or evening based on knowledge of local temperature patterns. The warming blanket would be energized at those times when condensation would be expected to collect and would operate for a long enough period to evaporate the condensation or to prevent its formation. Alternatively, the moisture level in the sensing chamber 104 could be monitored by moisture sensors which would activate the warming blanket as needed.

The practice of the present invention comprehends the installation of the sensor apparatus in both new fuel dispensers as they are being constructed and as a retrofit modification for dispensers already in service. Accordingly, the scope of the present invention includes a retrofit kit for a fuel dispenser having a vapor recovery system and vapor return passage 8. The kit may include a Y-shaped fitting and hydrocarbon sensor that are installed preferably in a vertical section of the vapor return piping within a fuel dispenser. The kit could comprise the fitting alone or, alternatively, could comprise the kit along with a hydrocarbon sensor installed therein.

The present invention includes providing a sensing housing positioned adjacent a dispenser vapor return passage so as to provide fluid communication with the return vapor flow in the passage and to discourage entry of liquid into the sensing housing. The practice of the present invention does not limit the orientation of a hydrocarbon sensor within the sensing housing and sensor chamber. Depending on the number of factors including throughput through the dispenser, local weather conditions, and the type of sensor used, a number of different sensor orientations may be used within the sensing housing. It follows that the sensor positioning illustrated herein is merely exemplary and not limiting of the present invention.

The present invention has been described herein with respect to certain embodiments and arrangements. The scope of the invention includes other such embodiments that provide for directing a flow of vapor through a vapor passage, admitting a portion of the vapor in the flow of vapor from the vapor passage to an adjacent sensing housing, while not admitting any appreciable amounts of liquid hydrocarbons. The invention further includes determining the presence of hydrocarbon in the diverted portion. The vapor flow potentially may contain hydrocarbons in vapor and/or liquid form.

Conversely, the practice of the present invention could include monitoring the return vapor flow for its oxygen content. It will be readily understood that any particular hydrocarbon content of the vapor flow has a corresponding oxygen content. That is, if the hydrocarbon content is 5% then the oxygen content must be 95%. Thus, the control of the vapor recovery system described herein above may be achieved by monitoring the oxygen content of the vapor flow as well as the hydrocarbon content thereof. A system for using vapor flow oxygen content in this fashion is disclosed in United Kingdom published patent application 2 316 060 ("the '060 patent publication"), the content of which is incorporated herein by reference. The '060 patent publication system relies on the expected increased oxygen content of the return vapor flow from an ORVR vehicle to halt operation of a vacuum pump. The system and method disclosed in the '275 patent could be adapted for use with an oxygen sensor by including an additional component that would convert information regarding oxygen content to hydrocarbon content. This component could include a hard wired device included as part of the sensor itself on printed circuit board 106,206, or, alternatively, software instructions contained in the vapor recovery system controller. In its broadest aspect then, the present invention includes the provision of a vapor sensor in fluid communication with the return vapor flow. This sensor could be a hydrocarbon sensor or an oxygen sensor.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

We claim:

1. An apparatus for sensing the hydrocarbon concentration of a vapor flow in a vapor passage comprising:

a. a sensor housing positioned adjacent the vapor passage so as to provide fluid communication with the vapor flow and to discourage entry of liquid into the sensor housing;

b. a vapor inlet positioned in the vapor passage for admitting vapor into the sensor housing;

c. a hydrocarbon sensor mounted in a sensor chamber defined within the sensor housing; and d. a venturi mounted in the vapor return passage such that the venturi draws a portion of the vapor flow into the sensor chamber into contact with the hydrocarbon sensor.

2. A method of sensing the presence of hydrocarbons in a vapor flow contained in a vapor passage comprising:

a. directing a flow of vapor potentially containing hydrocarbons in liquid and vapor form through a vapor passage;

b. admitting a portion of the vapor in the flow of vapor from the vapor passage to an adjacent sensor housing, while not admitting an appreciable amount of liquid hydrocarbons;

c. positioning a venturi in the vapor passage such that the venturi draws a portion of the vapor into the sensor housing; and d. determining the presence of hydrocarbon in the diverted portion.

3. A vapor measurement system comprising:

a. a vapor passage;

b. a sensor chamber having an inlet port and an outlet port, said inlet and outlet ports being connected to said vapor passage;

c. a sensor located in said sensor chamber for sensing a vapor concentration;

d. said vapor passage having a smaller diameter where said outlet port connects than where said inlet port connects thereby drawing vapor from said vapor passage into said inlet port and through said chamber and outlet port.

4. The system of claim 3, wherein said outlet port connects to a point along said vapor passage at a throat having the smallest diameter.

5. The system of claim 3, wherein said outlet port connects to said sensor chamber at a lowest point to capture condensation and direct it towards said vapor passage.

6. The system of claim 3, wherein said sensor chamber is positioned above said vapor passage such that vapor condensation within said chamber moves towards said vapor passage.

7. The system of claim 3, wherein said sensor is an infrared vapor sensor for determining the vapor concentration within said chamber.

8. The system of claim 3, wherein said sensor is an oxygen sensor.

9. The system of claim 3, wherein said sensor is a hydrocarbon sensor.

10. The system of claim 3, wherein said outlet port connects to said vapor passage downstream of said inlet port.

11. A system for determining vapor concentration within a vapor recovery environment, said system comprising:

a. a vapor recovery line;

b. a chamber having:

i. a main sensor chamber;

ii. an inlet port extending between said vapor recovery line and said main sensor chamber, said inlet port positioned at a point wherein said vapor recovery line has a first diameter;

iii. an outlet port extending between said main sensor chamber and said vapor recovery line, said outlet port connecting to said vapor recovery line at a point wherein said vapor recovery line has a smaller diameter than said first diameter;

iv. said chamber having a lower sidewall angled towards said outlet port for directing vapor condensation towards said outlet port;

c. a sensor for sensing the vapor concentration within said main sensor chamber.

12. The system of claim 11, wherein said inlet port enters said main sensor chamber at a point above said outlet port.

13. The system of claim 12, wherein said inlet and outlet ports enter said chamber along said lower sidewall.

14. The system of claim 11, wherein said vapor recovery line includes an orifice restrictor for limiting said second diameter.

15. The system of claim 14, wherein said orifice restrictor is selected from the group consisting of a venturi, laminar flow element, and an orifice plate.

16. The system of claim 11, wherein vapor pressure is greater along said vapor recovery line within said first diameter than said second diameter.

17. A fuel dispenser comprising:

a. a storage tank;

b. a fuel delivery hose extending from said storage tank and terminating at a nozzle;

c. a vapor recovery line extending between said nozzle and said storage tank, said vapor recovery line having a section with a first diameter and at least a second section having a smaller diameter;

d. a vapor pump operatively connected to said vapor recovery line for moving vapor along said vapor recovery line; and e. a chamber including:

i. an inlet port extending from said vapor recovery line, said inlet port connecting to said vapor recovery line at a point where said vapor recovery line has said first diameter;

ii. an outlet port extending from said vapor recovery line downstream from said inlet port, said outlet port connecting to said vapor recovery line at a point where said vapor recovery line has said smaller diameter;

iii. a main sensor chamber connected to said inlet and outlet ports; and iv. a sensor for determining the amount of vapor within said main sensor chamber.

18. The system of claim 17, wherein said main sensor chamber includes a lower section and an upper section, said inlet and outlet ports connected into said lower section, and said sensor positioned within said upper section.

19. The system of claim 18, further including a baffle separating said lower section from said upper section.

20. The system of claim 17, wherein said lower section includes a sidewall angling towards said outlet port for removing vapor condensation.

21. The system of claim 17, wherein said vapor recovery line includes a constrictor for forming said smaller diameter.

22. The system of claim 21, wherein said orifice restrictor is selected from the group consisting of a venturi, laminar flow element, and an orifice plate.

23. A method of determining the vapor concentration within a vapor recovery system comprising the steps of:

a. drawing vapor through a vapor recovery line;

b. causing a pressure drop at a point along the vapor recovery line thereby drawing vapor from the vapor recovery line into a chamber;

c. sensing a hydrocarbon concentration of the vapor; and d. returning the vapor back to the vapor recovery line.

24. The method of claim 23, further including positioning an outlet port from the chamber along the vapor recovery line the pressure drop point.

* * * * *